US006435509B2

(12) United States Patent
Wichinsky et al.

(10) Patent No.: US 6,435,509 B2
(45) Date of Patent: Aug. 20, 2002

(54) METHOD OF PLAYING A MULTIPLE-DRAW POKER CARD GAME

(76) Inventors: Michael Wichinsky, 711 Lacy La., Las Vegas, NV (US) 89107; Don Hesskamp, 2575 S. Highland Dr., Las Vegas, NV (US) 89109

( * ) Notice: Subject to any disclaimer, the term of this patent is extended or adjusted under 35 U.S.C. 154(b) by 0 days.

(21) Appl. No.: 09/752,317

(22) Filed: Jan. 2, 2001

Related U.S. Application Data

(63) Continuation-in-part of application No. 09/712,746, filed on Nov. 15, 2000, and a continuation-in-part of application No. 09/389,604, filed on Sep. 3, 2000, now Pat. No. 6,206,375.

(51) Int. Cl.[7] ..... A63F 1/00

(52) U.S. Cl. ..... 273/292; 273/274; 273/309; 463/13

(58) Field of Search ..... 273/292, 274, 273/309; 463/13

(56) References Cited

U.S. PATENT DOCUMENTS

| | | | | | |
|---|---|---|---|---|---|
| 5,810,663 | A | * | 9/1998 | Bochichio et al. | 463/13 |
| 5,816,914 | A | * | 10/1998 | Wichinsky | 463/13 |
| 5,823,873 | A | * | 10/1998 | Moody | 463/13 |
| 6,007,066 | A | * | 12/1999 | Moody | 273/292 |
| 6,048,267 | A | * | 4/2000 | Wichinsky | 463/13 |
| 6,098,985 | A | * | 8/2000 | Moody | 273/292 |
| 6,129,357 | A | * | 10/2000 | Wichinsky | 273/292 |
| 6,132,311 | A | * | 10/2000 | Williams | 463/193 |
| 6,159,095 | A | * | 12/2000 | Frohm et al. | 463/19 |
| 6,206,375 | B1 | * | 3/2001 | Wichinsky | 273/292 |

* cited by examiner

*Primary Examiner*—Benjamin H. Layno
*Assistant Examiner*—D Collins
(74) *Attorney, Agent, or Firm*—Harry M. Weiss; Jeffrey Weiss; Weiss & Moy, P.C.

(57) ABSTRACT

A new method of playing multiple-draw poker that provides players with the opportunity to progressively build poker hands by duplicating held cards from a latest completed hand into a new hand.

12 Claims, 2 Drawing Sheets

METHOD OF PLAYING A MULTIPLE-DRAW POKER CARD GAME

CROSS-REFERENCE TO RELATED APPLICATIONS

This is a continuation-in-part of both U.S. patent application Ser. No. 09/389,604 filed Sep. 3, 2000 and now U.S. Pat. No. 6,206,375, and U.S. patent application Ser. No. 09/712,746 filed Nov. 15, 2000 both in the name of one of the applicants to which priority is claimed.

FIELD OF THE INVENTION

This invention relates generally to card games and methods therefor and, more particularly, to a method of playing multiple-draw poker that would provide players with the opportunity to progressively build poker hands by duplicating held cards from a latest completed hand into a new hand.

BACKGROUND OF THE INVENTION

Many card games have been developed over the years for both social and gambling purposes. Poker, with all of its variations, is perhaps the most popular gambling card game. When playing against opponents, the general aim of poker is to collect a five card hand that is superior to opponents five card hands or to try to bet in such a way (called "bluffing") as to cause opponents to believe that their hand is inferior and subsequently "fold" (concede or turn in) their hand. In video poker, however, there are often no opponents and therefore no bluffing. Winning at video poker generally means collecting a five card hand of at least a minimum predetermined value.

Many people find that the basic game of poker has become somewhat stale and boring. Attempts have been made to liven up the game in several different ways. In video poker machines, for example, variations on the game of poker exist which cannot be found in casino poker rooms (e.g. wild cards and jokers). In addition, some video poker machines allow the player to play multiple hands of poker simultaneously. In one popular variation known as Triple Play®, the player receives three hands of poker. The Triple Play® variations are covered in U.S. Pat. No. 5,823,873 issued to Moody. In one variation of this game, after receiving an initial hand of five cards the player can choose to select as few as zero and as many as all of the five cards as cards to be held. All held cards from the initial hand immediately show up in the remaining two hands. When the player then selects the draw function, the video poker machine completes all three hands up to five cards, making a five card hand in each of the three hands. Similar variations allow as many as 10 hands of poker to be played simultaneously in the same fashion.

However, when playing against opponents in a live game, or playing video poker gaming machines (including Triple Play® and its variations) the player is generally limited to exercising his or her discretion in the selection process only during the initial hand of a single game, and before the player draws cards to complete the hand. The player therefore cannot progressively build future poker hands based on previously completed (i.e. post-draw) poker hands. In Triple Play® and its variations, it is generally only with the initial hand, and before any cards to complete the hand are drawn, that the player may choose which cards to hold and which cards to discard. After the cards in the initial hand have been selected, those same cards are automatically selected in all remaining hands, eliminating the opportunity for any future selection process in any of the remaining hands which could lead to building progressively better poker hands. For example, in prior art games if an initial hand in multiple-draw poker includes tow Jacks and the player selects them as cards to be held (while at the same time discarding the three other cards) then the second hand and all other subsequent hands will include those same pair of Jacks. In these prior art games, if, in the second hand, the player draws three more cards to complete his or her hand and receives a third Jack (and two other cards of no poker value) this player has no ability to make that third Jack a held card for a third hand, and so on. The prior art does not allow a player to progressively build poker hands by continuing to duplicate cards to be held from previously completed (i.e.. after the draw) hands.

A need therefore existed for providing a new, exciting method of playing multiple-draw poker that would provide players with the opportunity to progressively build poker hands by duplicating held cards from a latest completed hand into a new hand.

SUMMARY OF THE INVENTION

An object of the present invention is to provide a new method for playing multiple-draw poker in which a player has the opportunity to select which cards to hold in each hand of a multiple-draw poker game.

It is a further object of the present invention to provide a new method for playing multiple-draw poker in which a player has the opportunity to progressively build poker hands by duplicating held cards from a latest completed hand into a new hand.

It is yet a further object of the present invention to provide a new method for playing multiple-draw poker in which a player has the opportunity to wager separate amounts on each hand of a multiple-draw poker game.

It is still a further object of the present invention to provide a new method for playing multiple-draw poker which utilizes a 60 card deck with 15 ranked cards.

BRIEF DESCRIPTION OF THE PREFERRED EMBODIMENTS

In accordance with one embodiment of the present invention, a method for playing a multiple-draw card game of poker is disclosed comprising, in combination, the steps of dealing a first hand of at least five cards, selecting as few as none and as many as all of the at least five cards of the first hand as cards to be held, discarding cards from the first hand not selected as cards to be held, duplicating the held cards of the first hand into a second hand, drawing additional cards to complete the first hand to have at least five cards, drawing additional cards to complete the second hand to have at least five cards, selecting as few as zero and as many as all of the at least five cards of the second hand as cards to be held, duplicating the held cards of the second hand into a third hand, drawing additional cards to complete the third hand to have at least five cards, and determining a poker hand value of a completed first hand and a completed second hand and a completed third hand.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

The present invention includes several embodiments of a method for playing a multiple-draw card game of poker, preferably on video gaming machines.

Figure 1:
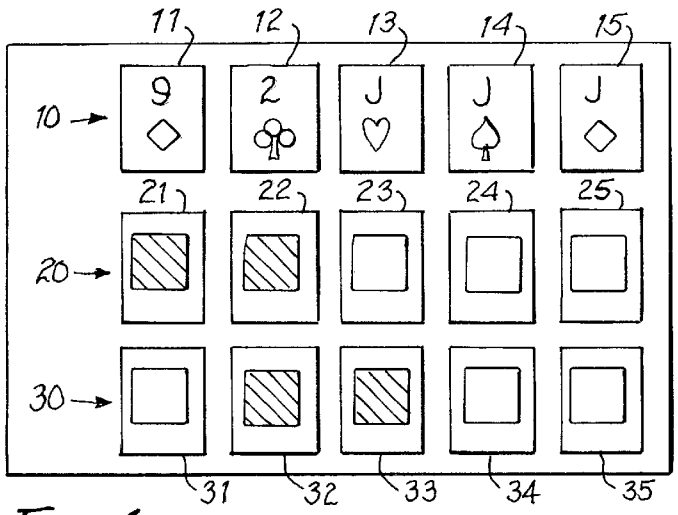
FIG. 1 is a top view of the preferred embodiment of the present invention showing an initial hand exposed in the first row, after the initial deal of the cards but before the draw.

Referring to FIG. 1, three rows of cards are shown, consisting of a first hand 10, a second hand 20 and a third hand 30. The first step in the method is the dealing of a first hand 10 of at least five cards. In FIG. 1, the first hand 10 hand already been dealt and the exposed cards happen to be: Nine of Diamonds 11, Two of Clubs 12, Three of Hearts 13, Jack of Spades 14 and Jack of Diamonds 15. The second hand 20 and the third hand 30 are shown with their cards face down. Although the first hand 10 is shown with five cards, it should be understood that more than 5 cards could be used to obtain a poker hand, such as in the poker game 7-card stud, and that this would be within the spirit and scope of this invention. The second step of the method for playing a multiple-draw card game of poker is to select as few as none and as many as all of the cards 11, 12, 13, 14, and 15 of the first hand 10 as cards to be held.

Figure 2:
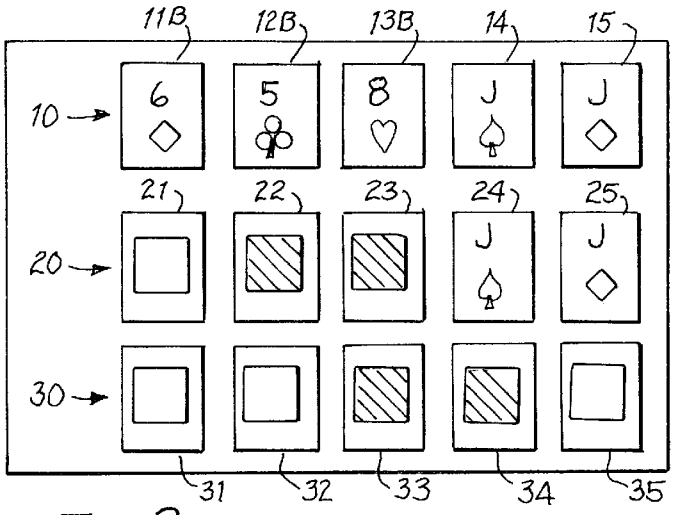
FIG. 2 is a top view of the preferred embodiment of the present invention showing the initial hand exposed in the first row after the draw and the second hand in the second row with the held cards from the first hand exposed.

Referring now to FIGS. 1 and 2, given the composition of the poker hand 10, the player would most likely hold the Jack of Spades 14 and the Jack of Diamonds 15 (thereby discarding the remaining cards Nine of Diamonds 11, Two of Clubs 12, and Three of Hearts 13) and attempt to draw a higher ranked poker hand, such as two-pair, three-of-a-kind, a full-house or four-of-a-kind. It should be understood, however, that the player has the decision to discard all five cards 11, 12, 13, 14, and 15 or hold all five cards 11, 12, 13, 14, and 15 or hold some of the cards 11, 13, 13, 14, and 15 while discarding other. Once the player selects the cards to be held, in this case, the Jack of Spades 14 and the Jack of Diamonds 15, those cards are then duplicated into a second hand 20 where they take the place of the face-down cards 24 and 25. In the preferred embodiments, the drawn cards are dealt face-up, avoiding the need for the player to have to press a button or turn the cards over him or herself, however, it should be understood that substantial benefit, such as increased suspense and excitement, could be derived from the cards being dealt face-down, therefore requiring the player to have to press a button or turn the cards over him or herself.

Referring now to FIG. 2, the player can then draw cards to replace the discarded Nine of Diamonds 11, Two of Clubs 12 and Three of Heart 13 to complete the first hand 10. In this case, the new cards are the Six of Diamonds 11B, the Five of Clubs 12B, and the Eight of Hearts 13B. The next step in the method for playing a multiple-draw card game of poker is to draw additional cards to complete the second hand 20 to have at least five cards. In FIG. 2, this would require revealing cards 21, 22 and 23.

Figure 3:
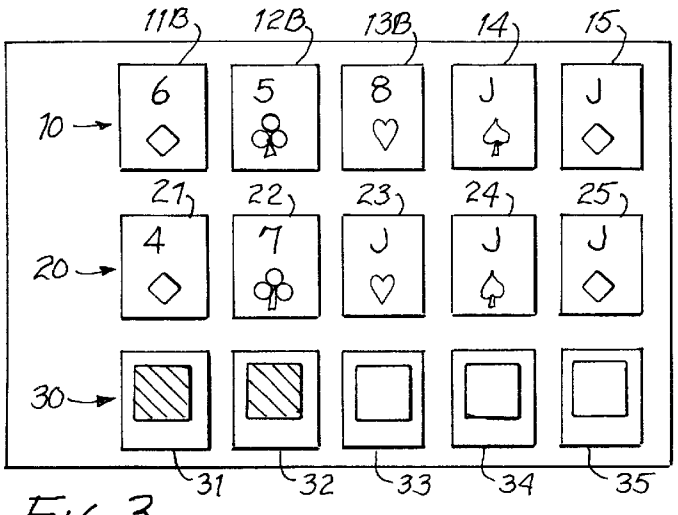
FIG. 3 is a top view of the preferred embodiment of the present invention showing the initial hand exposed in the first row after the draw and the completed second hand exposed in the second row including the held cards from the first hand.

Referring now to FIG. 3, these cards turned out to be the Four of Diamonds 21, the Seven of Clubs 22, and the Jack of Hearts 23. The player can now select as few as zero and as many as all of the at least five cards of the second hand 20 as cards to be held. Given the composition of the poker hand 20, the player would most likely hold the Jack of Spades 24, the Jack of Diamonds 25, and the Jack of Hearts 23 (thereby discarding the remaining cards 21 and 22) and attempt to draw a higher ranked poker hand such as a full-house or four-of-a-kind.

Figure 4:
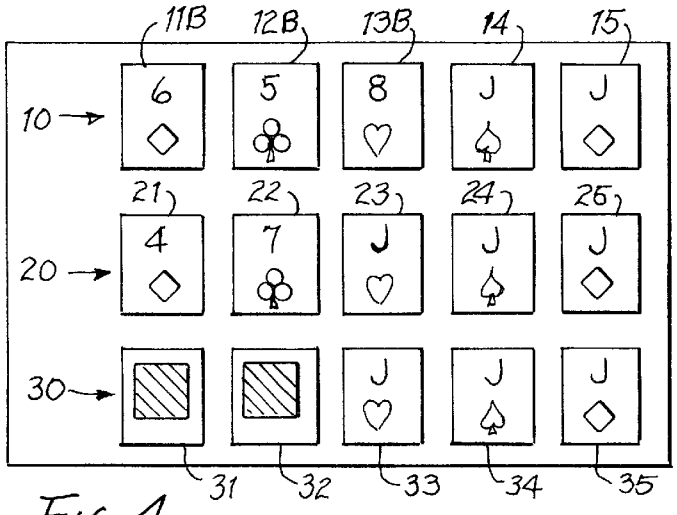
FIG. 4 is a top view of the preferred embodiment of the present invention showing the initial hand exposed in the first row after the draw, and the completed second hand exposed in the second row including the held cards from the first hand, and the third hand in the third row with the held cards from the second hand exposed.

Referring now to FIG. 4, once the player selects the cards to be held, in this case, the Jack of Spades 24, the Jack of Diamonds 25, and the Jack of Hearts 23, those cards are then duplicated into a third hand 30 where they take the place of the face-down cards 33, 34 and 35 (shown in FIG. 3).

Figure 5:
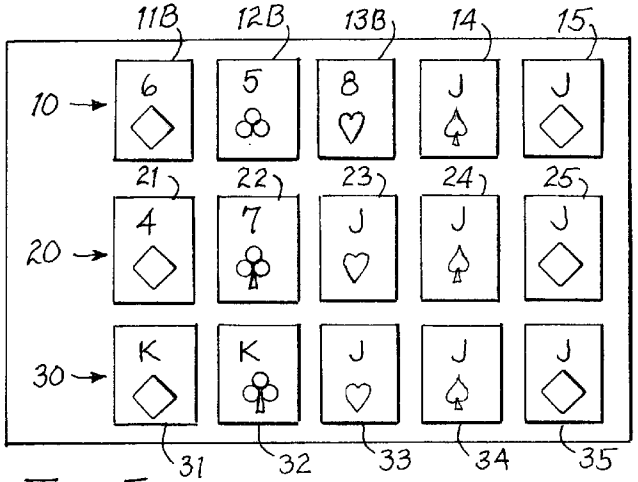
FIG. 5 is a top view of the preferred embodiment of the present invention showing the initial hand exposed in the first row after the draw, and the completed second hand in the second row exposed including the held cards from the first hand, and the completed third hand exposed in the third row including the held cards from the second hand.

Referring now to FIG. 5, additional cards are now drawn to complete the third hand 30 to have at least five cards. This would require revealing face-down cards 31 and 32 (shown in FIG. 4). In this case, the cards turned out to be the King of Diamonds 31 and the King of Clubs 32, giving the player a full-house. Once all of the hands been completed, the poker hand value is determined of the completed first hand 10, the completed second hand 20 and the completed third hand 30. In the preferred embodiment, the method for playing a card game of poker involves three hands, however, it is possible to implement this same method with four or more hands. With more than three hands, the poker hand values of all of the hands are determined, and the method is complete, after all hands have been completed.

In the preferred embodiment, the player may wager money on the card game and receive a predetermined amount of money back if one or more of the player's completed hands meets a predetermined poker hand value. In this way, it is possible that the player could lose money on one or more of the hands and make money on one or more of the hands, or lose money on all of the hands, or make money on all of the hands.

Preferably, the game is played with a single fifty-two card deck (not counting the duplicated cards), although there are several alternative embodiments. One possible embodiment would be to use multiple decks in which a single fifty-two card deck is used for the first hand 10 and then the second hand 20 uses a forty-seven card deck consisting of a standard fifty-two card deck with the five cards 11, 12, 13, 14 and 15 of the first hand 10 omitted therefrom and the third hand 30 also uses a forty-seven card deck consisting of a standard fifty-two card deck with the five cards 21, 22, 23, 24 and 25 of the second hand 20 omitted therefrom, and so on, whereby additional hands beyond the third hand 30 all use forty-seven card decks consisting of standard fifty-two card decks with the five cards of the previously completed hand omitted therefrom.

Figure 6:
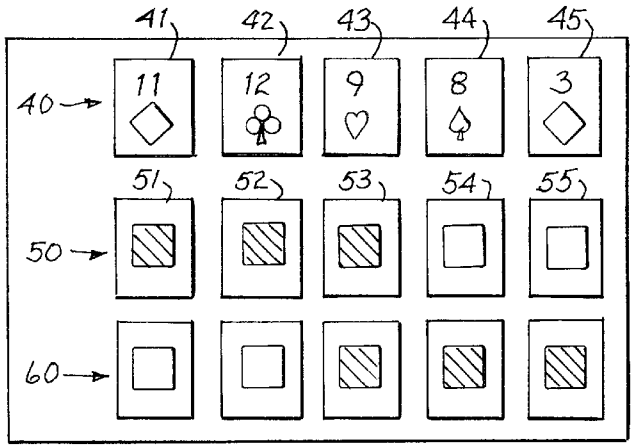
FIG. 6 is a top view of an alternative embodiment of the present invention which uses a sixty card deck, showing the initial hand exposed and having an "Eleven" and a "Twelve" in the first row, after the initial deal of the cards but before the draw.
Figure 7:
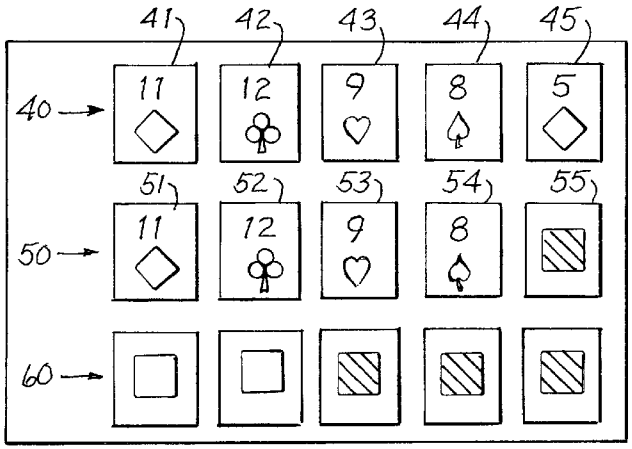
FIG. 7 is a top view of an alternative embodiment of the present invention which uses a sixty card deck, showing the initial hand exposed in the first row after the draw and the second hand in the second row with the held cards from the first hand exposed.
Figure 8:
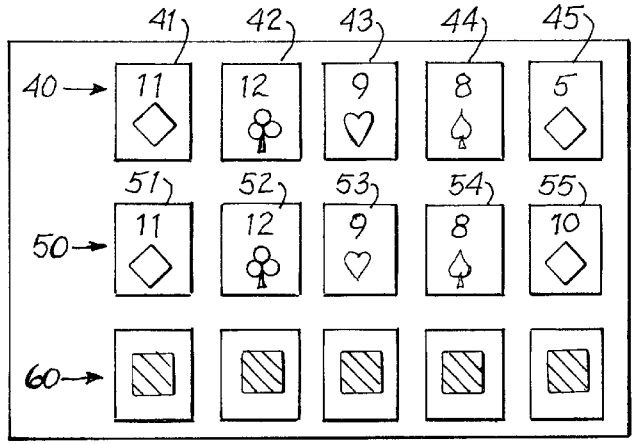
FIG. 8 is a top view of the preferred embodiment of the present invention which uses a sixty card deck, showing the initial hand exposed in the first row after the draw and the completed second hand exposed in the second row including the held cards from the first hand.

Referring now to FIGS. 6–8, an alternative embodiment of the present invention is shown. The alternative embodiment is essentially the same as the preferred embodiment, although a sixty card deck is used, comprising a standard fifty-two card deck of praying cards and eight additional playing cards comprising four different suited playing cards each having a value of Eleven and four different suited playing cards each having a value of Twelve.

The four cards with the value of "Eleven" are all higher in rank by one that the standard "Ten" card in a fifty-two card deck. Additionally, the four cards with the value of "Twelve" are all higher in rank by one than the "Eleven" card. The "Eleven" and "Twelve" cards add a new dimension to standards poker hands. For example, in a standard fifty-two card deck, one possible five card poker hand is a "straight," which is five cards in order, regardless of suit (e.g. 4-5-6-7-8 or K-Q-J-10-9). When two players each have a straight, the highest straight wins (e.g. J-10-9-8-7 beats 10-9-8-7-6). In a standard 52 card deck, the possibilities range from A-2-3-4-5 all the way up to A-K-Q-J-10, for a total of ten different possible straights (regardless of suit).

With the addition of an "Eleven" card and a "Twelve" card, however, there are new straight possibilities, such as 7-8-9-10-11 or 8-9-10-11-12. The "Eleven" and "Twelve" can also be used as cards immediately lower in rank than the face cards, such as in a straight 11-12-J-Q-K or 12-J-Q-K-A. However, the "Eleven" and "Twelve" cards do not necessarily have to replace the conventional Ace high straight (i.e. 10-J-Q-K-A). For example, in the same poker game, it could be possible to have an 12-J-Q-K-A straight and a 11-J-Q-K-A straight as well as a conventional 10-J-Q-K-A.

Referring now to FIG. 6, the method of playing a multiple draw poker game utilizing a sixty-card deck is illustrated. The method of playing a multiple-draw poker game is the same as in the preferred embodiment with three rows of cards, consisting of a first hand 40, a second hand 50 and a third hand 60. The first hand 40 has already been dealt and the exposed cards happen to be: Eleven of Diamonds 41, Twelve of Clubs 42, Nine of Hearts 43, Eight of Spades 44 and Three of Diamonds 45. The second hand 40 and third hand 50 are shown with their cards face down.

Referring now to FIGS. 6 and 7, given the composition of the poker hand 40, the player would most likely hold the Eleven of Diamonds 41, Twelve of Clubs 42, Nine of Hearts 43, and Eight of Spades 44 (thereby discarding the Three of Diamonds 45) and attempt to draw a straight. Once the player selects the cards to be held, those cards are then duplicated into a second hand 50 where they take the place of the face-down cards 51, 52, 53, and 54.

Referring now to FIG. 7, the player can then draw a new card to replace the discarded Three of Diamonds 45, which in this case is the Five of Diamonds 45B. This completes the hand 40. The next step is for the player to draw additional cards to complete the hand 50 to have at least five cards. In FIG. 7, this would require revealing card 55.

Referring now to FIG. 8, this card turned out to be the Ten of Diamonds 55, giving the player a straight (8-9-10-11-12) in the hand 50. With a straight, the player would most likely select all five cards as cards to be held, and then have them duplicated into hand 60. It should be clearly understood that while the alternative embodiment of the method of playing a multiple-draw poker game utilizing a sixty-card deck is shown in FIGS. 6–8 with only two completed hands, this method could be used with three or more hands in the same way as the preferred embodiment of the present invention. Similarly, the alternative embodiment of the method of playing a multiple-draw poker game utilizing a sixty-card deck could also be played using a single sixty card deck or multiple sixty card decks in the same fashion as the method using a single fifty-two card deck or multiple fifty-two card decks is practiced.

While the invention has been particularly shown and described with reference to preferred embodiments thereof, it will be understood by those skilled in the art that the foregoing and other changes in form and details may be made therein without departing from the spirit and scope of the invention.

We claim:

1. A method for playing a multiple-draw card game of poker comprising, in combination, the steps of:

dealing a first hand of at least five cards;

selecting as few as none and as many as all of said at least five cards of said first hand as cards to be held;

discarding cards from said first hand not selected as cards to be held;

duplicating said held cards of said first hand into a second hand;

drawing additional cards to complete said first hand to have at least five cards;

drawing additional cards to complete said second hand to have at least five cards;

providing an option of selecting as few as zero, which would result in discarding one or more cards selected for said first hand, or as many as all of said at least five cards of said second hand as cards to be held;

duplicating said held cards of said second hand into a third hand;

drawing additional cards, if needed, to complete said third hand to have at least five cards; and determining a poker hand value of a completed first hand and a completed second hand and a completed third hand.

2. The method of claim 1 further comprising the steps of:

selecting as few as zero and as many as all of said at least five cards of a latest completed hand as cards to be held;

duplicating said held cards of said latest completed hand into a new hand;

drawing additional cards to complete said new hand to have at least five cards; and determining a poker hand value of all completed new hands.

3. The method of claim 1 wherein said cards of said first hand and said second hand said third hand are drawn face up.

4. The method of claim 1 further comprising the steps of:

a player wagering a wager on said card game; and paying said player a predetermined amount based on said poker hand value of said completed first hand and said completed second hand and said completed third hand.

5. The method of claim 1 further comprising the steps of:

a player wagering a wager on said first hand and a second wager on said second hand and a third wager on said third hand;

paying said player a predetermined amount based on said poker hand value of said completed first hand;

paying said player a predetermined amount based on said poker hand value of said completed second hand; and paying said player a predetermined amount based on said poker hand value of said completed third hand.

6. The method of claim 2 further comprising the steps of:

a player wagering a wager on said card game; and paying said player a predetermined amount based on said poker hand value of said all completed new hands.

7. The method of claim 2 further comprising the steps of:

a player wagering a wager on each hand of said card game;

paying said player a predetermined amount based on said poker hand values of all completed hands.

8. The method of claim 1 wherein said multiple-draw card game of poker uses a single 52 card deck.

9. The method of claim 1 wherein said multiple-draw card game of poker uses a single fifty-two card deck for said first hand and an initial forty-seven card deck for said second hand and a subsequent forty-seven card deck for said third hand, said initial forty-seven card deck of said second hand comprises a standard fifty-two card deck with said at least five cards of said first hand omitted therefrom and said subsequent forty-seven card deck of said third hand comprises a standard fifty-two card deck with said at least five cards of said second hand omitted therefrom.

10. The method of claim 2 wherein said card game of poker uses a single fifty-two card deck for said first hand and a new forty-seven card deck for each additional new hand, said new forty-seven card deck comprises a standard fifty-two card deck with said at least five cards of said latest completed hand omitted therefrom.

11. The method of claim 1 wherein said multiple-draw card game of poker uses a sixty card deck comprising:

a standard fifty-two card deck of playing cards; and eight additional playing cards comprising four different suited playing cards each having a value of 11 and four different suited playing cards each having a value of 12.

12. The method of claim 11 wherein said different suited playing cards are clubs, diamonds, hearts and spades.

* * * * *